United States Patent [19]

Frederick

[11] 4,175,362

[45] Nov. 27, 1979

[54] WALL STRUCTURE

[76] Inventor: Charles V. Frederick, Rte. #5, New Virginia, Iowa 50210

[21] Appl. No.: 879,064

[22] Filed: Feb. 21, 1978

[51] Int. Cl.[2] ..... E04B 1/00

[52] U.S. Cl. ..... 52/274; 52/293

[58] Field of Search ..... 52/274, 293, 299, 269

[56] References Cited

U.S. PATENT DOCUMENTS

| | | | |
|---|---|---|---|
| 3,160,248 | 12/1964 | Galajikian | 52/293 |
| 3,216,163 | 11/1965 | Carew | 52/274 X |
| 3,312,018 | 4/1967 | Fourmanoit | 52/274 X |
| 4,015,399 | 4/1977 | Prins | 52/293 |

*Primary Examiner*—J. Karl Bell

*Attorney, Agent, or Firm*—Zarley, McKee, Thomte, Voorhees & Sease

[57] ABSTRACT

A wall structure comprising a plurality of vertically disposed and horizontally spaced columns secured to a supporting surface such as a floor or the like and extending upwardly therefrom. A vertically disposed panel member is positioned between adjacent pairs of the columns to create a wall surface. Each of the columns comprises a plurality of column members secured together by means of bolts to form the column. The panel members each have opposite side edge portions with arcuate lips or channels formed therein which are received between pairs of the column members and which engage flanges on the column members to prevent the separation of the panel members from the columns. Various embodiments of the columns are disclosed for creating corner columns, intermediate columns and dividing wall columns.

7 Claims, 6 Drawing Figures

WALL STRUCTURE

BACKGROUND OF THE INVENTION

This invention relates to a wall structure and more particularly to a wall structure which may be quickly and easily assembled while yet maintaining a high degree of strength.

Many types of wall structures have been previously disclosed and have been found to be generally satisfactory. For example, in applicant's earlier U.S. Pat. No. 3,971,180, a wall structure was disclosed wherein the columns were created by securing a pair of vertically disposed channels together at the sides edges thereof with vertically disposed panels being secured to the columns and extended therebetween. The wall structure disclosed in the above-identified patent has met with success but the instant invention represents a significant advance thereover.

It is therefore a principal object of the invention to provide an improved wall structure.

A further object of the invention is to provide a wall structure wherein a plurality of panel members may be secured to spaced-apart columns in a variety of different configurations.

A still further object of the invention is to provide a wall structure which is easily assembled into a structurally sound wall structure.

A still further object of the invention is to provide a wall structure which is comprised of a plurality of columns having panel members secured thereto with means for preventing the separation thereof.

A still further object of the invention is to provide a wall structure which includes a plurality of hollow columns adapted to have concrete placed therein after the wall structure has been assembled.

A still further object of the invention is to provide a wall structure which is economical of manufacture, durable in used and refined in appearance.

These and other objects will be apparent to those skilled in the art.

SUMMARY OF THE INVENTION

Figure 1:
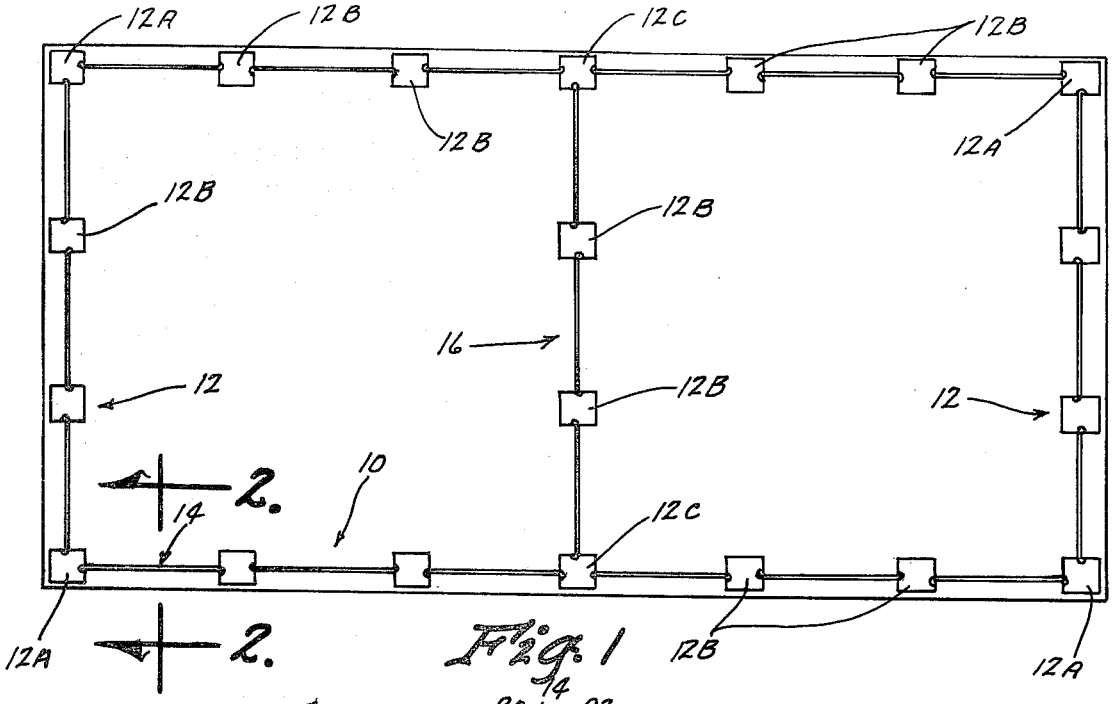
FIG. 1 is a plan view of the wall structure extending upwardly from a supporting surface.
Figure 2:
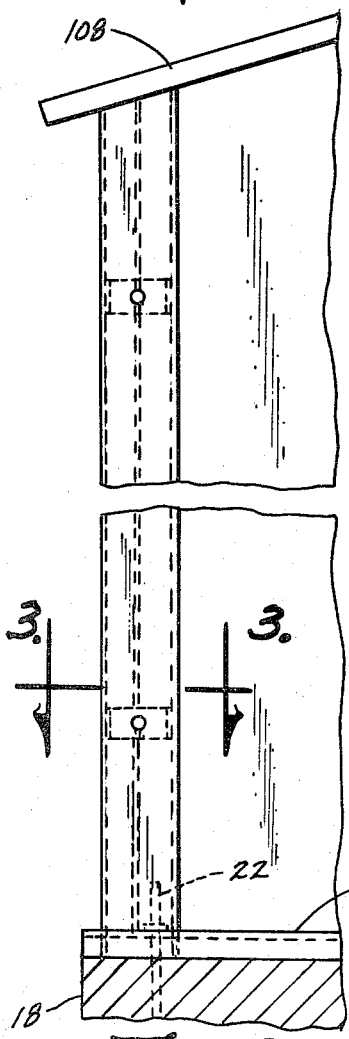
FIG. 2 is a partial side view of the structure with the broken lines illustrating structure not ordinarily visible.

A wall structure is disclosed wherein a plurality of vertically disposed and horizontally spaced hollow columns are secured to a supporting surface and extend upwardly therefrom. Panel members are positioned between adjacent pairs of columns and have the edge portions received thereby to prevent the separation of the panels from the columns. The columns are comprised of a plurality of column members which are secured together to form the column and which receive the side edge portions of the panel members therebetween. After the wall structure has been assembled, concrete is poured downwardly into the columns to strengthen the wall structure.

DESCRIPTION OF THE PREFERRED EMBODIMENT

The wall structure of this invention is referred to generally by the reference numeral 10 generally comprising a plurality of columns 12 having panel members 14 secured to adjacent pairs of columns and extending therebetween as will be described in more detail hereinafter. For purposes of description, the columns 12 will be described as comprising corner columns 12A, intermediate columns 12B and columns 12C which connect the dividing walls 16 to the side walls as will also be described in more detail hereinafter.

The numeral 18 designates a conventional supporting surface such as a concrete floor or the like preferably having an inverted U-shaped channel 20 secured thereto by suitable anchors or the like and positioned below the wall structure. The numeral 22 refers to reinforcing rods which are embedded in the floor 18 and which extend upwardly into the lower ends of each of the columns. It should also be noted that the rods 22 extends upwardly through suitable openings formed in the channels 20.

Figure 3:
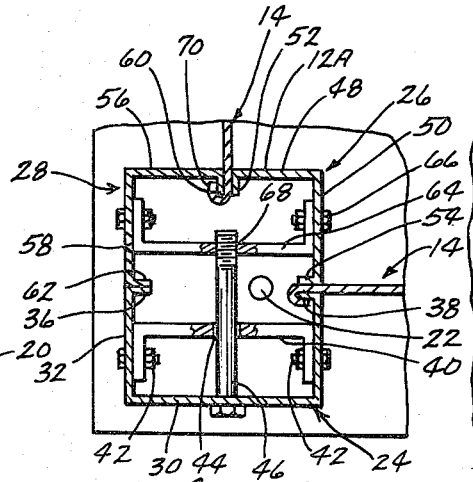
FIG. 3 is an enlarged sectional view seen on lines 3—3 of FIG. 2.

FIG. 3 illustrates the corner column 12A and it can be seen that it is comprised of column members 24, 26 and 28. Column member 24 comprises wall members 30, 32 and 34. As seen in FIG. 3, wall members 32 and 34 are provided with inwardly extending flanges 36 and 38 respectively. A plurality of vertically spaced channels or brackets 40 are secured to wall members 32 and 34 by bolts 42 and extend therebetween as best illustrated in FIG. 3. Each of the brackets 40 is provided with an opening 44 formed therein adapted to receive the bolt 46 which is extended through wall member 30 and through the opening 44.

Column member 26 is comprised of wall members 48 and 50 having inwardly extending flanges 52 and 54 respectively. Column member 28 comprises wall portions 56 and 58 having inwardly extending flanges 60 and 62 respectively. A plurality of vertically spaced channels or brackets 64 are secured to wall members 56 and 58 by bolts 66 and extend therebetween in the manner depicted in FIG. 3. Bracket 64 is provided with a threaded opening 68 adapted to threadably receive the threaded portion of the bolt 46.

The column 12A and the adjacent panel members 14 are assembled by initially positioning the arcuate lip or channel 70, at one side edge of the panel member 14, between the flanges 52 and 60 so that flange 60 is received by the channel 70. Bolts 66 are then secured as previously described so that the bracket 64 prevents the separation of the column members 26 and 28 to positively maintain the panel member 14 in position. The other panel member 14 is then positioned between the flanges 54 and 38 with the flange 38 being received by the arcuate channel portion 70 of the panel member 14. Bolt 46 is then extended through the wall member 30, opening 44 and is threadably secured to the threaded opening 68 which draws the column member 24 towards the column members 26 and 28 and to positively secure the same thereto so that the panel member 14 extending to the right as viewed in FIG. 3 is positively and rigidly secured thereto.

Figure 6:
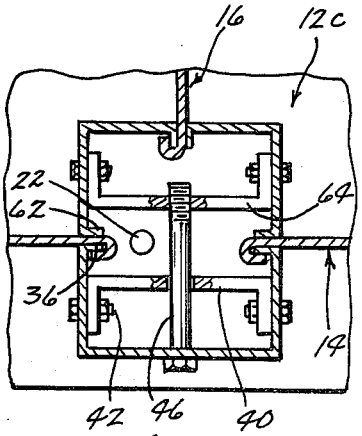
FIG. 6 is a view similar to FIG. 4 except that it illustrates a modified form of the column which is used at the juncture of the dividing wall and outer wall.

The column 12C illustrated in FIG. 6 is identical to column 12A except that a panel member 14 is positioned between the flanges 36 and 62. In other words, the column 12C has three of the panels 14 secured thereto rather than the two panels which are employed with the corner column 12A.

Figure 4:
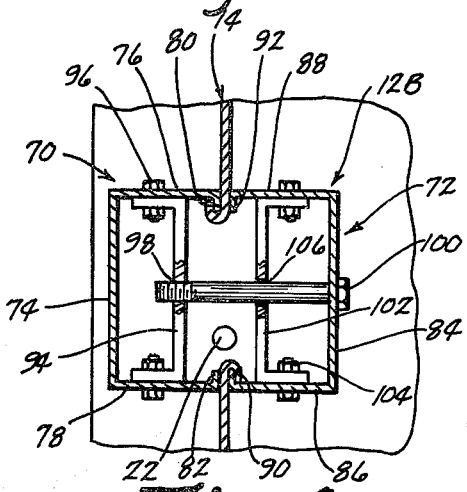
FIG. 4 is a sectional view similar to FIG. 3 except that it illustrates a column used on the dividing wall structure.

FIG. 4 illustrates the configuration of the intermediate column referred to by the reference numeral 12B. Column 12B is comprised of column members 70 and 72 which are generally in the form of channels. Column member 70 includes wall members 74, 76 and 78. Flanges 80 and 82 are provided on the inner ends of the wall members 76 and 78. Column member 72 includes wall members 84, 86 and 88 with the flanges 90 and 92 being provided on the inner ends of the wall members 86 and 88. A plurality of vertically spaced brackets 94 are secured to the wall members 76 and 78 by bolts 96 and have a threaded opening 98 formed therein adapted to threadably receive the bolt 100. A plurality of vertically spaced-apart brackets 102 are secured to the wall members 86 and 88 by bolts 104 and have an opening 106 formed therein adapted to receive the bolt 100 as seen in FIG. 4.

The arcuate side edge portions of the panels 14 are positioned relative to the column members as seen in FIG. 4 so that the flanges 80 and 90 are received by the arcuate channels at the ends of the adjacent panels 14. Bolt 100 is then extended through the wall member 84, opening 106 and threadably secured to the threaded opening 98 to draw the column members 70 and 72 together and to positively maintain the panel members 14 in the relationship seen in FIG. 4.

Figure 5:
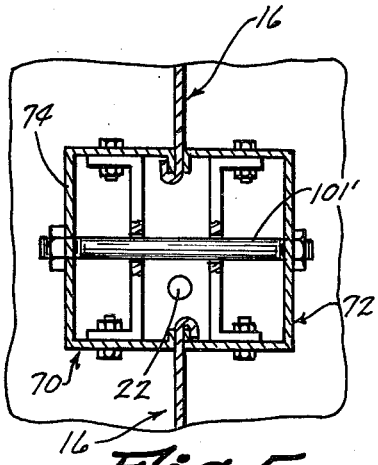
FIG. 5 is a view similar to FIG. 4 except that a modified connection means is disclosed.

The column illustrated in FIG. 5 is identical to that illustrated in FIG. 4 except that the threaded opening 98 has been omitted and an opening is formed in wall member 74 so that the bolt 101' may be completely extended through the column with nuts being secured to the outer ends thereof to draw the column members 70 and 72 together.

After the columns and panel members have been assembled in the desired pattern, concrete is poured downwardly into the open upper ends thereof so as to completely fill the same so that the reinforcing rods 22 are embedded in the concrete. After the concrete has sufficiently cured, the roof 108 may be secured to the wall structure by any convenient means.

The wall structure disclosed herein is not only easy to assemble but is extremely versatile. It can be appreciated that a variety of wall configurations as well as dividing walls may be provided with a limited inventory. In other words, a contractor need only maintain an inventory of the panels 14, columns 12A and 12B and is able to assemble a wide variety of wall configurations with that limited inventory.

The resulting wall structure will be extremely durable due to the manner in which the panel members are secured to the columns and the manner in which the columns themselves are secured to the reinforcing rods extending upwardly from the supporting surface. The flat exterior and interior surfaces of the panels as well as the columns insure that material will not cling thereto.

A definite advantage of the wall structure disclosed herein is that the columns as well as the panels may be constructed of galvanized material. The column members may be formed from flat galvanized material in conventional fashion so that the cost of the components is greatly reduced. Galvanized material has the advantage of adhering very rigidly to concrete.

Thus it can be seen that a unique wall structure has been described which accomplishes at least all of its stated objectives.

I claim:

1. A building structure comprising,
a supporting surface,
a plurality of vertically disposed and horizontally spaced-apart columns secured at their lower ends to said supporting surface and extending upwardly therefrom,
at least one vertically disposed panel member positioned between each pair of adjacent columns, each of said panel members having opposite side edge portions,
each of said columns being comprised of a plurality of column members secured together to form the said column,
each column having complementary flanges provided thereon which extend therefrom into the interior of said column,
the side edge portions of said panel members having generally U-shaped channels which are received between a pair of adjacent flanges of adjacent column members of a column,
bolt means securing together the column members of each of said columns, and
one of said flanges on each of said column members being received in a single U-shaped channel of separate panel members, whereby said panel members are secured against horizontal movement outwardly of said columns.

2. The structure of claim 1 wherein at least some of said columns are intermediate wall columns,
each of said intermediate wall columns comprising first and second vertically disposed channel shaped column members each having a pair of wall members extending transversely from the opposite ends of a third wall member,
said transversely extending wall members having flanges formed thereon which extend into the interior of said column,
said first and second column members being positioned so that said flanges are positioned adjacent one another,
one of said side edge portions of one of said panel members being received between adjacent flanges.

3. The structure of claim 2 wherein at least some of said columns are dividing wall columns,
said dividing wall columns each comprising one of said channel shaped column members and a pair of generally L-shaped column members,
each L-shaped column member comprising a pair of generally perpendicularly disposed wall members which each have an interiorly extended flange formed thereon,
said dividing wall columns having parallel panel members extending oppositely therefrom and a third panel member extending therefrom transversely to said pair of panel members,
each parallel panel having a side edge portion received between adjacent flanges of said channel shaped column member and an L-shaped column member, and
said third panel member having a side edge portion received between adjacent flanges of said pair of L-shaped column members.

4. The structure of claim 1 wherein said means securing the column members together comprises a plurality of vertically spaced brackets secured to the column members and extending therebetween.

5. The structure of claim 4 wherein said means securing the column members together also comprises a bolt means extending from one of said column members for connection to said brackets.

6. The structure of claim 2 wherein a plurality of vertically spaced brackets are secured to each of said first and second channel members, the brackets secured to one of said channel members having threaded openings formed therein, said means securing said channel members together comprising a bolt means extending through one of said channel members and being threadably received by said threaded opening.

7. The structure of claim 3 wherein at least some of said columns are corner columns comprising a one of said channel shaped column members having a pair of said L-shaped column members secured thereto, each of said corner columns having first and second panel members secured thereto and extending therefrom at right angles with respect to each other.

* * * * *